US011027893B2

(12) United States Patent
French et al.

(10) Patent No.: US 11,027,893 B2
(45) Date of Patent: Jun. 8, 2021

(54) PACKAGE

(71) Applicant: Berry Global, Inc., Evansville, IN (US)

(72) Inventors: Jordan Robert French, Evansville, IN (US); Seth Tempel, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 16/295,182

(22) Filed: Mar. 7, 2019

(65) Prior Publication Data

US 2019/0276193 A1 Sep. 12, 2019

Related U.S. Application Data

(60) Provisional application No. 62/639,595, filed on Mar. 7, 2018.

(51) Int. Cl.

| | |
|---|---|
| ***B65D 43/16*** | (2006.01) |
| ***B65D 77/04*** | (2006.01) |
| ***B65D 5/66*** | (2006.01) |
| ***B65D 8/00*** | (2006.01) |
| ***B65D 43/02*** | (2006.01) |

(52) U.S. Cl.

CPC ..... *B65D 43/161* (2013.01); *B65D 5/6632* (2013.01); *B65D 11/02* (2013.01); *B65D 43/0225* (2013.01); *B65D 43/0235* (2013.01); *B65D 77/046* (2013.01); *B65D 2251/02* (2013.01); *B65D 2251/04* (2013.01); *B65D 2251/1016* (2013.01); *B65D 2251/20* (2013.01); *B65D 2543/00092* (2013.01)

(58) Field of Classification Search

USPC .... 206/528, 529, 530, 531, 532, 534, 534.1, 206/536, 538, 533, 540

See application file for complete search history.

(56) References Cited

U.S. PATENT DOCUMENTS

| | | | | |
|---|---|---|---|---|
| 4,752,014 | A | 6/1988 | House et al. | |
| 5,449,078 | A | 9/1995 | Akers | |
| 5,908,125 | A | 6/1999 | Opresco | |
| 6,076,689 | A | 6/2000 | Vassallo | |
| 6,173,838 | B1 * | 1/2001 | Brozell | B65D 77/02 206/472 |
| 6,679,381 | B1 | 1/2004 | Bush | |
| 7,549,541 | B2 * | 6/2009 | Brozell | B65D 83/0463 206/531 |
| 7,757,843 | B2 | 7/2010 | Katsis | |
| 8,066,122 | B2 | 11/2011 | Beecroft et al. | |
| 8,220,636 | B2 | 7/2012 | Beecroft et al. | |
| 8,292,110 | B2 | 10/2012 | Rutter et al. | |
| 9,694,955 | B2 | 7/2017 | Wu et al. | |
| 9,878,821 | B2 | 1/2018 | Sibley | |
| 9,895,698 | B2 | 2/2018 | Spielman | |
| 2002/0185404 | A1 * | 12/2002 | Donegan | B65D 77/02 206/531 |

(Continued)

OTHER PUBLICATIONS

Leafs by Snoop—Pentagram. [online]. Pentagram, 1972 [retrieved on May 16, 2019]. Retrieved from the Internet: <URL: www.pentagram.com/work/leafs-by-snoop-1.html>.

(Continued)

*Primary Examiner* — Jacob K Ackun

(57) ABSTRACT

A container with a selectively openable cover to selectively allow access to one or more compartments is disclosed.

9 Claims, 18 Drawing Sheets

(56) References Cited

U.S. PATENT DOCUMENTS

| | | | | |
|---|---|---|---|---|
| 2007/0023317 | A1* | 2/2007 | Brozell | B65D 83/0463 206/538 |
| 2009/0255842 | A1* | 10/2009 | Brozell | B65D 83/0463 206/531 |
| 2010/0025355 | A1 | 2/2010 | Beecroft | |
| 2010/0133140 | A1* | 6/2010 | Bailey | B65D 11/12 206/538 |
| 2011/0000814 | A1* | 1/2011 | Lee | B65D 83/04 206/528 |
| 2011/0259783 | A1* | 10/2011 | Angelucci | B65D 50/046 206/538 |
| 2016/0039591 | A1 | 2/2016 | Kinzer | |
| 2016/0090213 | A1 | 3/2016 | Murray | |
| 2017/0027168 | A1 | 2/2017 | Heath | |
| 2017/0112181 | A1 | 4/2017 | Belfance et al. | |
| 2017/0113841 | A1 | 4/2017 | Murray | |
| 2017/0319009 | A1 | 11/2017 | Seckel et al. | |
| 2017/0349338 | A1 | 12/2017 | Ziering et al. | |
| 2018/0042890 | A1 | 2/2018 | Sinai et al. | |
| 2018/0273258 | A1 | 9/2018 | Luburic | |

OTHER PUBLICATIONS

Leafs by Snoop. [online]. [retrieved on May 16, 2019]. Retrieved from the Internet: <URL: www.leafsbysnoop.com/home/.html>.

Non Final Office Action of U.S. Appl. No. 16/295,186 dated Jul. 14, 2020, all enclosed pages cited.

Non Final Office Action of U.S. Appl. No. 16/295,192 dated Aug. 13, 2020, all enclosed pages cited.

Non Final Office Action of U.S. Appl. No. 16/295,202 dated May 28, 2020, all enclosed pages cited.

* cited by examiner

PACKAGE

PRIORITY CLAIM

This application claims priority under 35 U.S.C. § 119(e) to U.S. Provisional Application Ser. No. 62/639,595, filed Mar. 7, 2018, which is expressly incorporated by reference herein.

TECHNICAL FIELD

The present disclosure relates generally to a container, and more specifically to a container for storing perishables that has features for resisting undesired opening.

BACKGROUND

It is often desirable to provide a container for storing items, which may include perishable items, that also has features that prevent or inhibit undesired opening.

SUMMARY

Certain embodiments according to the present disclosure provide a package with one or more selectively openable and/or closable lid portions.

In one aspect, for example, a package is provided with a container having a floor and a side wall that cooperate to form a product storage region. The package also includes a lid having a cover that is movable between a closed position in which the cover is at least partially blocking access to the product storage region, and an open position in which the cover is at least partially moved away from the closed position such that the product storage region is accessible by a user. The container includes at least one pair of opposed depressible tabs that in a relaxed state are configured to retain the lid in a locked state, and in a compressed state are configured to allow the lid to move from the closed position to the open position. The lid includes a pair of opposed apertures configured to align with the at least one pair of opposed tabs in the closed state and allow disengagement of the tabs when the tabs are in the compressed state such that the tabs disengage the pair of opposed apertures and allow movement of the lid from the closed position to the open position.

In another aspect, a package is provided having a container having a first product storage region and a second product storage region separated by a divider wall. The package also includes a first cover selectively covering the first product storage region and a second cover selectively covering the second product storage region. The container has a first pair of opposed locking tabs and a second pair of opposed locking tabs. The first cover is movable between a closed position in which the first cover at least partially blocks access to the first product storage region, and an open position in which the first cover is at least partially moved away from the closed position such that the first product storage region is accessible by a user. The second cover is movable between a closed position in which the second cover at least partially blocks access to the second product storage region, and an open position in which the second cover is at least partially moved away from the closed position such that the second product storage region is accessible by a user. The first pair of opposed locking tabs are depressible and configured to be movable from a relaxed state in which the first pair of opposed locking tabs are configured to retain the first cover in a locked state, to a compressed state in which the first pair of opposed locking tabs are configured to allow the first cover to move from the closed position to the open position. The second pair of opposed locking tabs are depressible and configured to be movable from a relaxed state in which the second pair of opposed locking tabs are configured to retain the second cover in a locked state, to a compressed state in which the second pair of opposed locking tabs are configured to allow the second cover to move from the closed position to the open position. The first cover includes a first pair of opposed apertures configured to align with the first pair of opposed tabs in the closed state and allow disengagement of the first pair of opposed tabs when the tabs are in the compressed state such that the first pair of opposed tabs disengage the first pair of opposed apertures and allow movement of the first cover from the closed position to the open position. The second cover includes a second pair of opposed apertures configured to align with the second pair of opposed tabs in the closed state and allow disengagement of the second pair of opposed tabs when the tabs are in the compressed state such that the second pair of opposed tabs disengage the second pair of opposed apertures and allow movement of the second cover from the closed position to the open position.

In yet another aspect, a package assembly is provided including a container having a floor and a side wall that cooperate to form a product storage region, a tray that is configured to be attachable to the container side wall, and a lid that is configured to be attachable to the tray. The lid includes a cover that is movable between a closed position in which the cover at least partially blocks access to the product storage region, and an open position in which the cover is at least partially moved away from the closed position such that the product storage region is accessible by a user. The container includes at least one pair of opposed depressible tabs that in a relaxed state are configured to retain the cover in a locked state, and in a compressed state are configured to allow the cover to move from the closed position to the open position. The cover includes a pair of opposed apertures configured to align with the at least one pair of opposed tabs in the closed state and allow disengagement of the tabs when the tabs are in the compressed state such that the tabs disengage the pair of opposed apertures and allow movement of the cover from the closed position to the open position.

In some embodiments, the container, the tray, and the lid are independently injection molded of plastics materials and attached together to form the package.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
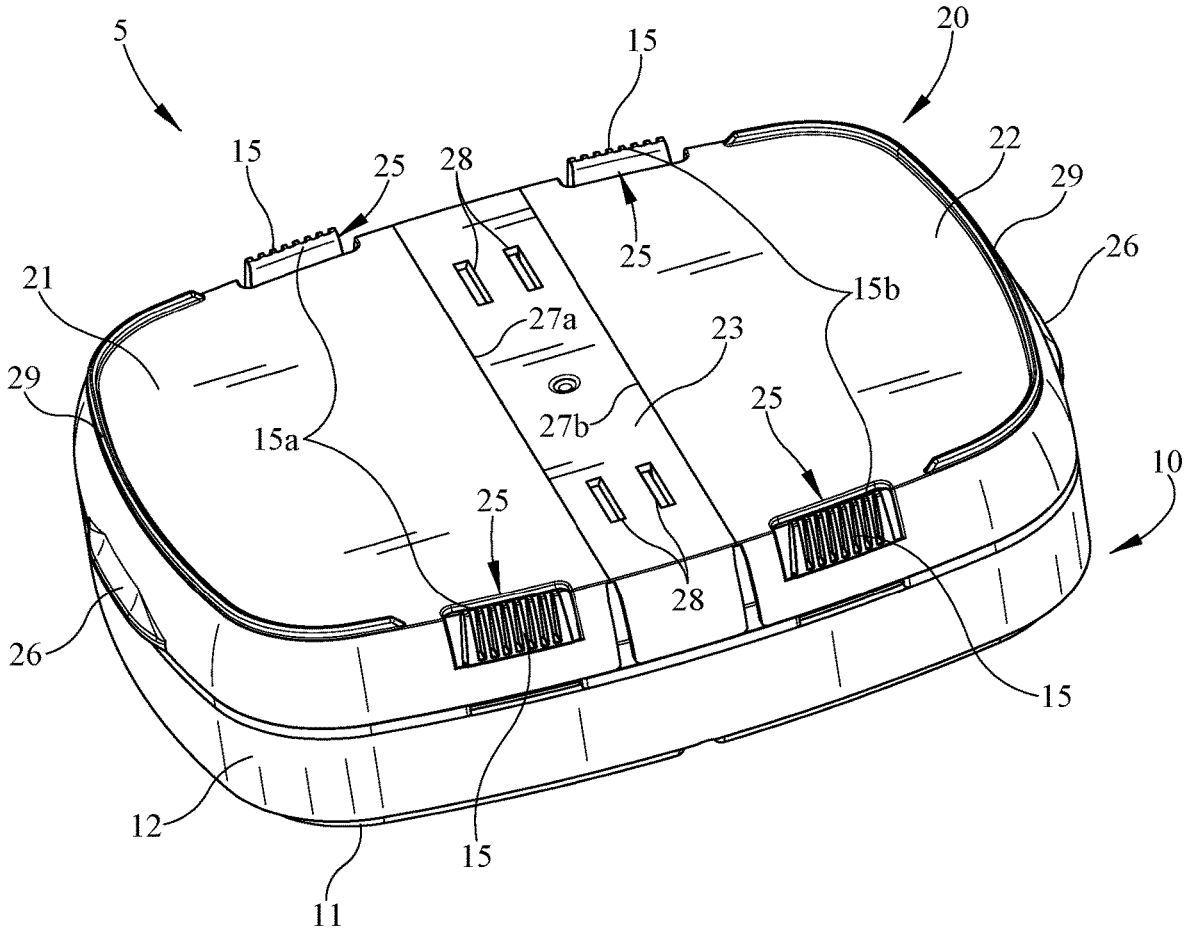
FIG. 1 illustrates a perspective view of an embodiment of a package in a closed position.

Some embodiments of a package 5 may include a container 10 and/or a lid 20, such as shown in FIG. 1 in an example of a closed position. Lid 20 may include one or more openable portions or sections, such as first cover 21 and/or second cover 22. Package 5 may be provided with one or more tabs 15, which may prevent or inhibit opening of either or both of first and second covers 21, 22. First and second covers 21, 22 may pivot and/or rotate open, for example, about one or more hinges or hinge lines, such as first hinge 27*a* and second hinge 27*b*, provided in lid 20. Lid 20 may also be provided with one or more finger tabs 26, for example, on each cover 21, 22 of lid 20 as shown in FIG. 1. A user may selectively open lid 20 and/or either cover 21, 22 by inwardly depressing or pushing opposing tabs 15, which may be attached and/or coupled to container 10, so that they will not engage a corresponding slot(s) 25 in lid 20, allowing respective covers 21, 22 to open about respective hinge lines 27*a*, 27*b*. Lid 20 may include a central attachment portion 23 that may be attached to, coupled to, affixed to, and/or integral with container 10 directly or indirectly. For example, lid 20 may include an attachment mechanism such as one or more protrusions or posts 28 configured to couple or attach to, for example snap into or plug fit, a corresponding attachment mechanism of container 10 such as corresponding post apertures 35, shown for example, in FIG. 5. Lid 20 may include an area for printing, affixing, and/or attaching one or more labels to the top surface, for example, that bounded by one or more bumpers 29. Such a label, if included, may cover more or more top surface features of lid 20, such as attachment posts 28, either or both hinge 27*a*, 27*b*, and/or other surface area or features of lid 20.

Figure 2:
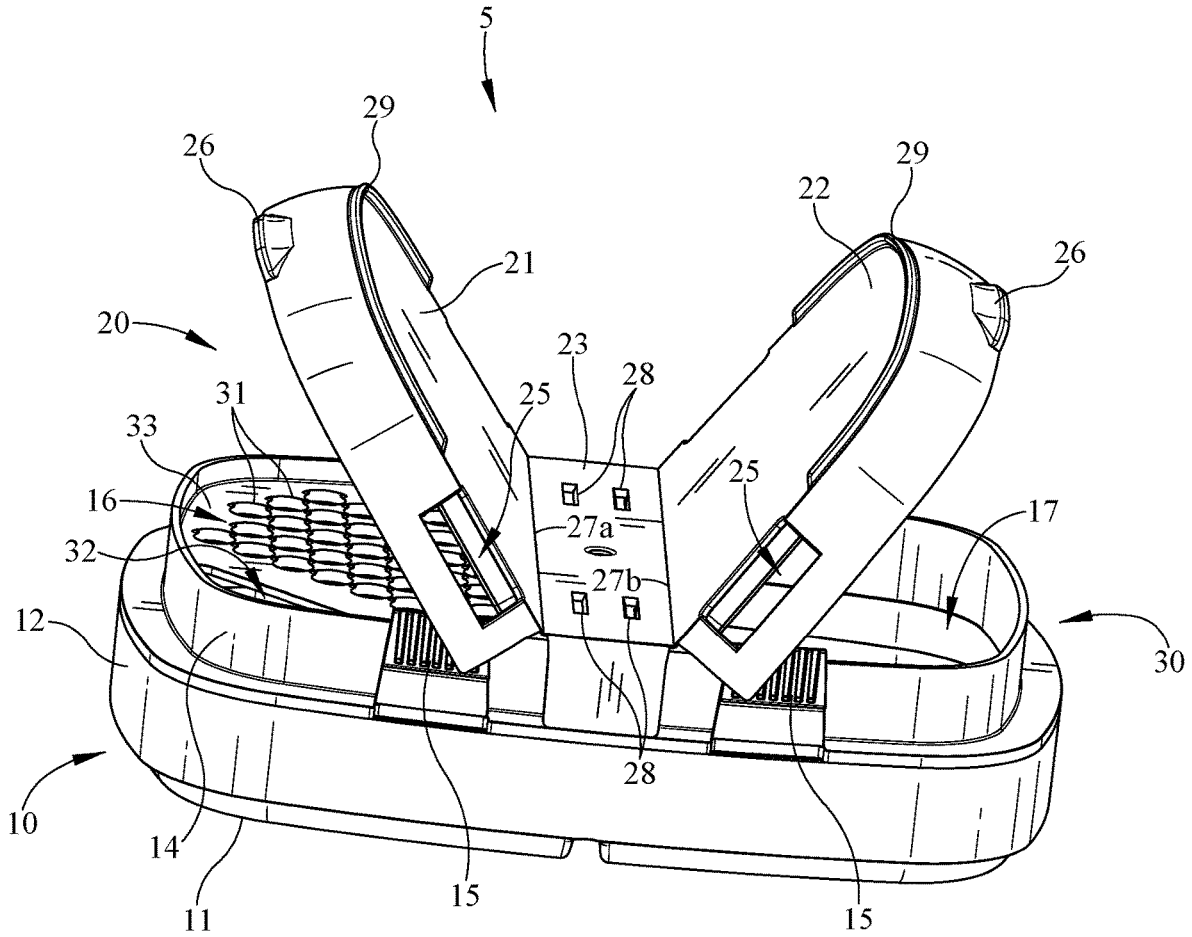
FIG. 2 illustrates a perspective view of the package of FIG. 1 in an open position.

Lid 20 may be opened at either or both of first cover 21 and second cover 22, for example, as shown in FIG. 2. Container 10 may include one or more compartments, such as first compartment 16 and second compartment 17, for any of a variety of reasons, including but not limited to for storing products or contents therein. In FIG. 2, first cover 21 is shown in an open position allowing access to first compartment 16, and second cover 22 is shown in an open position allowing access to second compartment 17. It is understood that, if more than one compartment is included, any or all compartments and/or lids or lid sections may be operated, opened, and/or closed independently of each other. For example, a user may open cover 22 to allow access to second compartment 17 while first cover 21 is in a closed position in relation to first compartment 16, or vice versa. As shown in FIG. 2, lid central attachment portion 23 may remain in a relatively fixed position relative to container 10 while either or both of covers 21, 22 are opened about respective hinges 27*a*, 27*b*.

Figure 3:
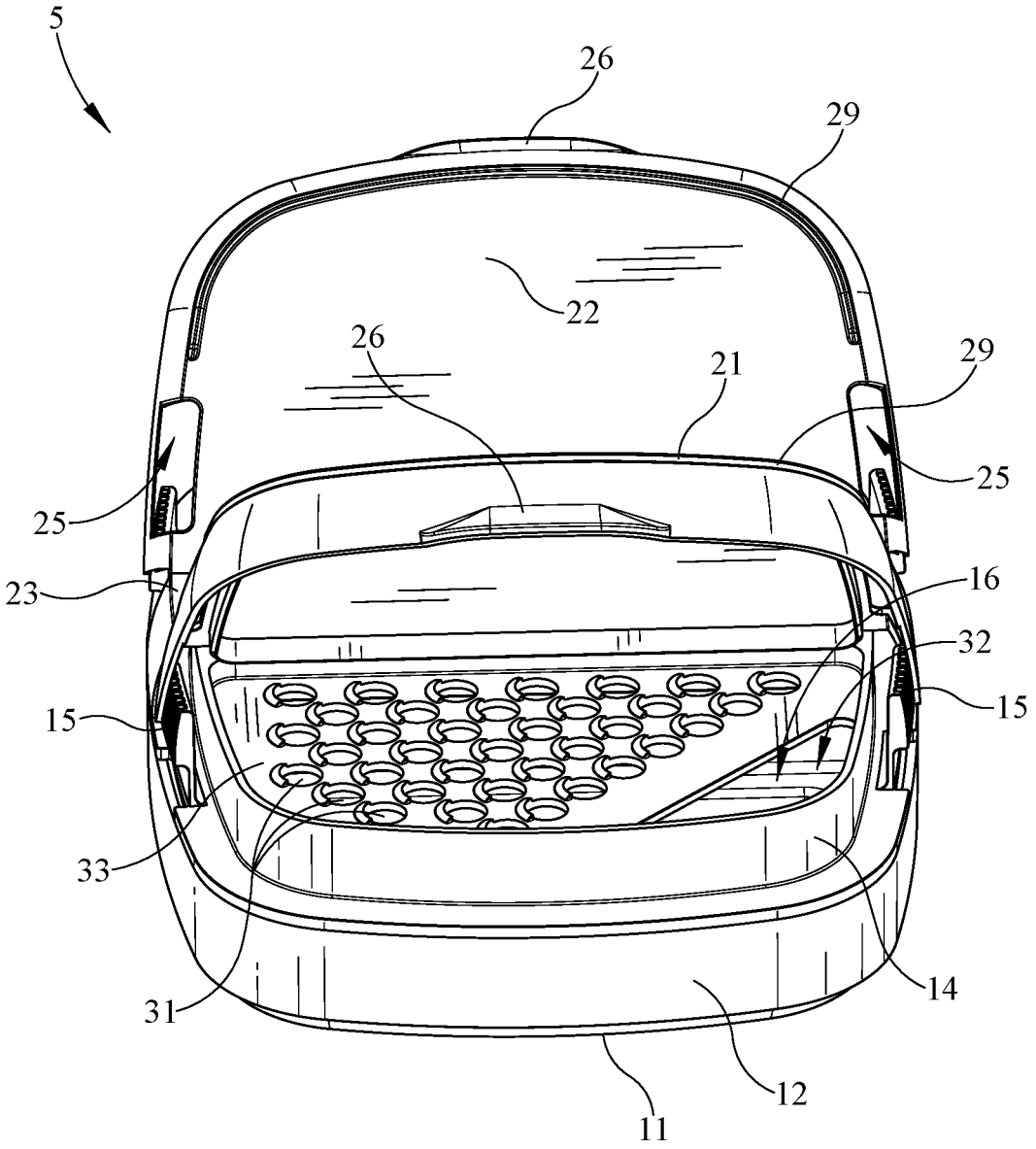
FIG. 3 illustrates a side perspective view of the package of FIG. 2.
Figure 7:
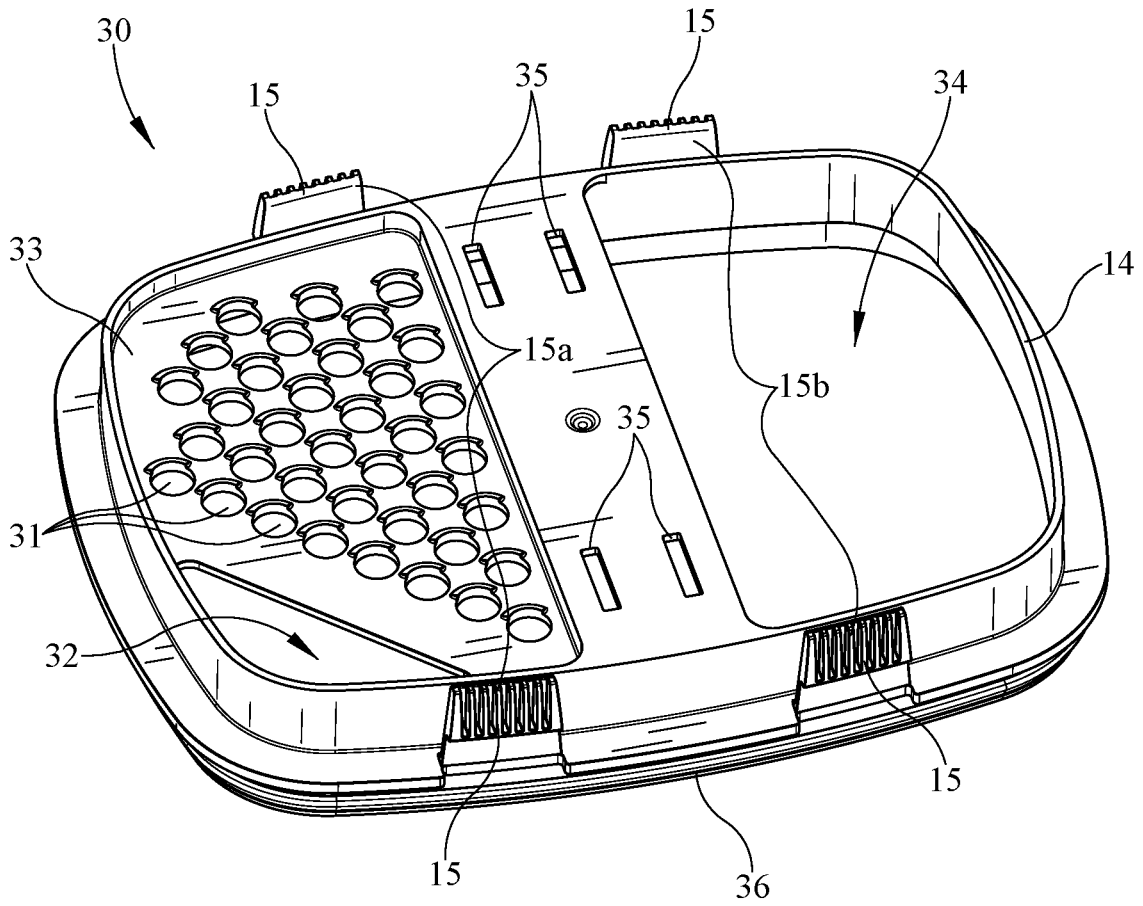
FIG. 7 illustrates a perspective view of the tray of FIG. 5.
Figure 8:
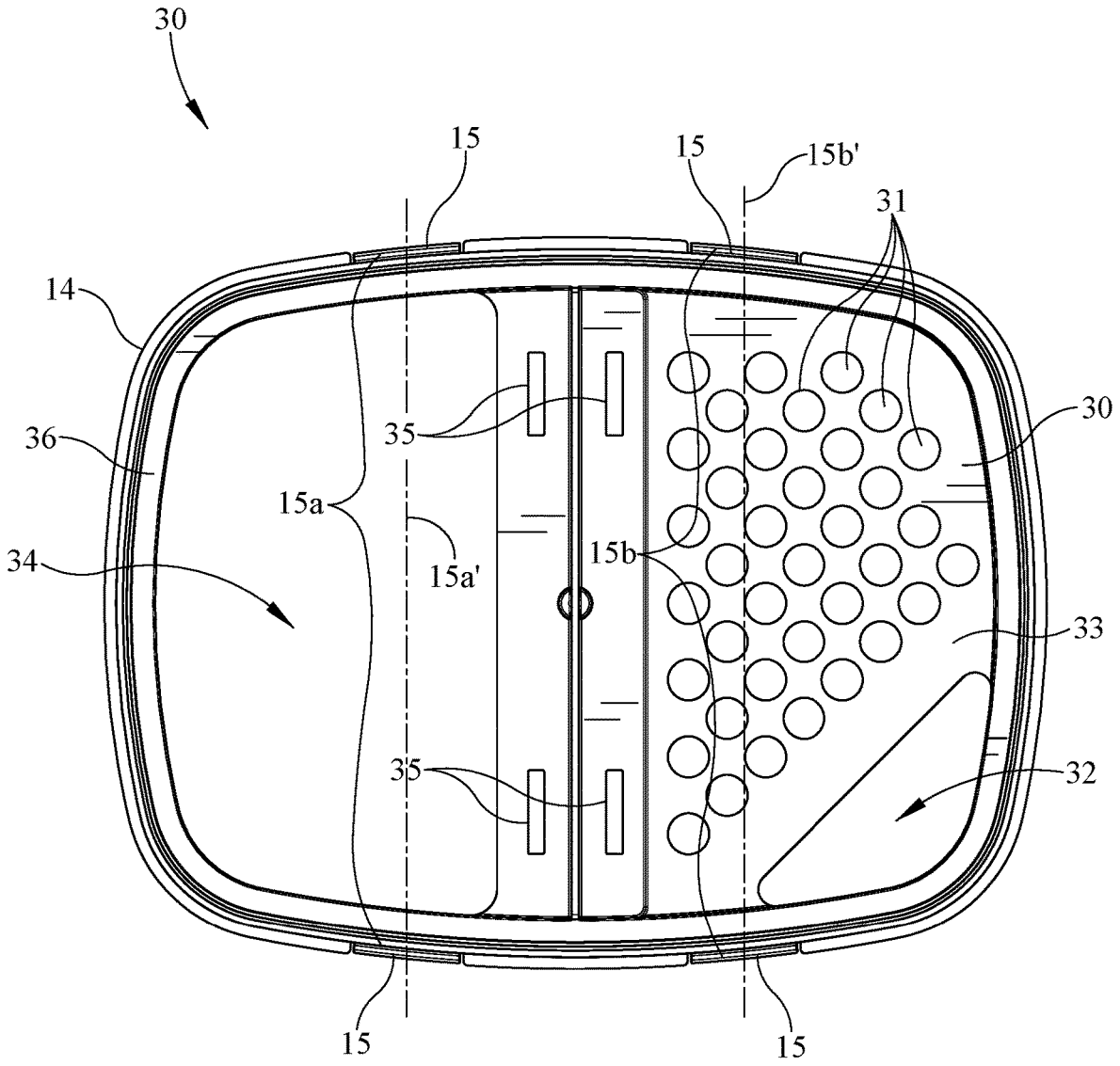
FIG. 8 illustrates a top view of the tray of FIG. 7.

A tray 30 is partially shown in FIG. 2, for example having a grater or grinder surface 33 with apertures 31 and opening 32, and may be included with package 5. Tray 30 may be an integral piece of container 10 or may be a separate component attachable to container 10. An embodiment of a separate tray 30 that is attachable to container 10 is shown in more detail in FIGS. 7 and 8. If a separate piece from container 10, tray 30 may be interposed between container 10 and lid 20. It is understood that container 10 as used herein may include tray 30 either as an integral component thereof or as a separate piece such as is shown in FIGS. 7 and 8. Tray 30, if included, may include any of a variety of features, such as grater surface 33 adjacent either or both of first compartment 16 and second compartment 17. As shown in FIG. 3, grater surface 33 is adjacent first compartment 16, while second compartment 17 is substantially open when second cover 22 is in an open position. In this embodiment, a user may access a product, item, or other contents of second compartment 17, and if desired may use grater surface 33 to grate the item into smaller pieces, which may then fall into first compartment 16 through grater apertures 31 and/or a surface opening 32. Surface opening 32, if included, may facilitate the passage of contents from first compartment 16 below tray 30 (e.g., contents that have already been grated or ground with grater surface 33) out of first compartment 16. Surface opening 32 may facilitate access to and/or removal of contents out of first compartment 16. Surface opening 32 being larger than any or all of grater apertures 31 may facilitate passage of contents from above grater surface 33 to at least partially within first compartment 16, if so desired.

Tray 30 may include a side wall 14 as shown in FIG. 2. Side wall 14 may have one or more sections or portions, for example, at either end, which substantially define openings into first compartment 16 and/or second compartment 17. Side wall 14 and/or either or both covers 21, 22 may be configured to cooperate to engage a relatively secure attachment and/or a sealing interface. For example, either or both cover 21, 22 may have a downwardly depending skirt or side wall as shown in FIG. 2, which may snap fit, friction fit, and/or form a plug seal with side wall 14. Container 10 may include side wall 12 that may, together with floor 11, define one or more compartments such as first compartment 16 and/or second compartment 17.

Tabs 15 may be provided, such as those shown in FIG. 2, for any of a variety of reasons, including but not limited to providing a locking mechanism and/or a child resistant opening feature. For example, any or all of tabs 15 may extend upwardly from an adjacent portion of tray 30 and/or container 10 to form a deflectable cantilever-type member. Tab 15 may include an outwardly protruding portion to engage with slot 25 of lid 20. Tab 15 and/or the outwardly protruding portion may configured to engage slot 25 and lock lid 20, first cover 21, and/or second cover 22 in a closed position by preventing slot 25 from raising above tab 15 until tab 15 is inwardly deflected, pushed, and/or depressed.

FIGS. 1 and 2 illustrate four tabs 15 configured in two pairs, a first pair of opposing locking tabs 15*a* and a second pair of opposing locking tabs 15*b*, with each pair 15*a*, 15*b* oppositely disposed a respective cover 21 or 22. A user may grasp either respective pair 15*a*, 15*b* of tabs 15, pulling or pushing them inwardly for example toward the interior of respective cover 21, 22 and/or compartment 16, 17. In this way, a user may selectively disengage tabs 15 from slots 25, removing the locking mechanism and/or allowing covers 21, 22 to be opened. For example, either or both cover 21, 22 may be opened upwardly, rotating about respective hinges 27*a*, 27*b*, when tabs 15 are disengaged or unlocked. First pair of opposing locking tabs 15*a* may be aligned with one another along a line 15*a*' (see, e.g., FIG. 8), and a user may depress or compress first pair of opposing locking tabs 15*a* toward one another along that line to disengage tabs 15 from slots 25 and/or release first lid 21 so that it may open. The line between opposing pair of locking tabs 15*a* may be substantially parallel to a hinge line of hinge 27*a*. Second pair of opposing locking tabs 15*b* may be aligned with one another along a line 15*b*', and a user may depress or compress second pair of opposing locking tabs 15*b* toward one another along that line to disengage tabs 15 from slots 25 and/or release second lid 22 so that it may open. The line between second pair of opposing locking tabs 15*b* may be substantially parallel to a hinge line of hinge 27*b*.

Figure 4:
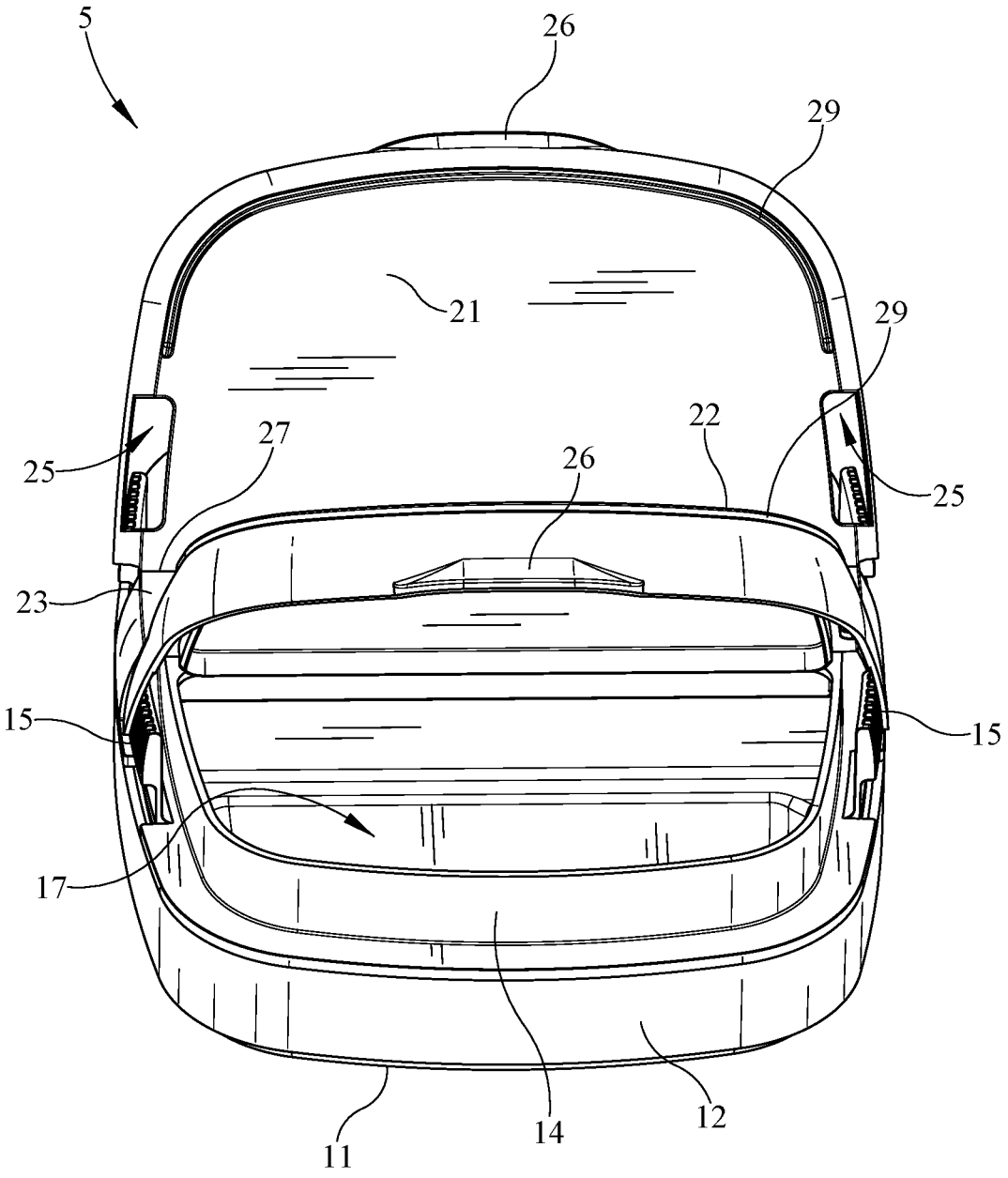
FIG. 4 illustrates another side perspective view of the package of FIG. 3.

FIGS. 3 and 4 show the respective ends of package 5 in more detail. FIG. 3 shows an embodiment of package 5 looking at components at or near cover 21 and/or first compartment 16. In this embodiment, grater surface 33 is located at this end of package 5. Apertures 31 and opening 32 are shown in more detail, looking into first compartment 16. FIG. 4 shows components at or near cover 22 and/or second compartment 17 in more detail. In this embodiment, tray 30 is substantially open at this end, allowing essentially unimpeded access to second compartment 17. This may allow for access and/or easier ingress or egress of relatively large items or objects.

Figure 5:
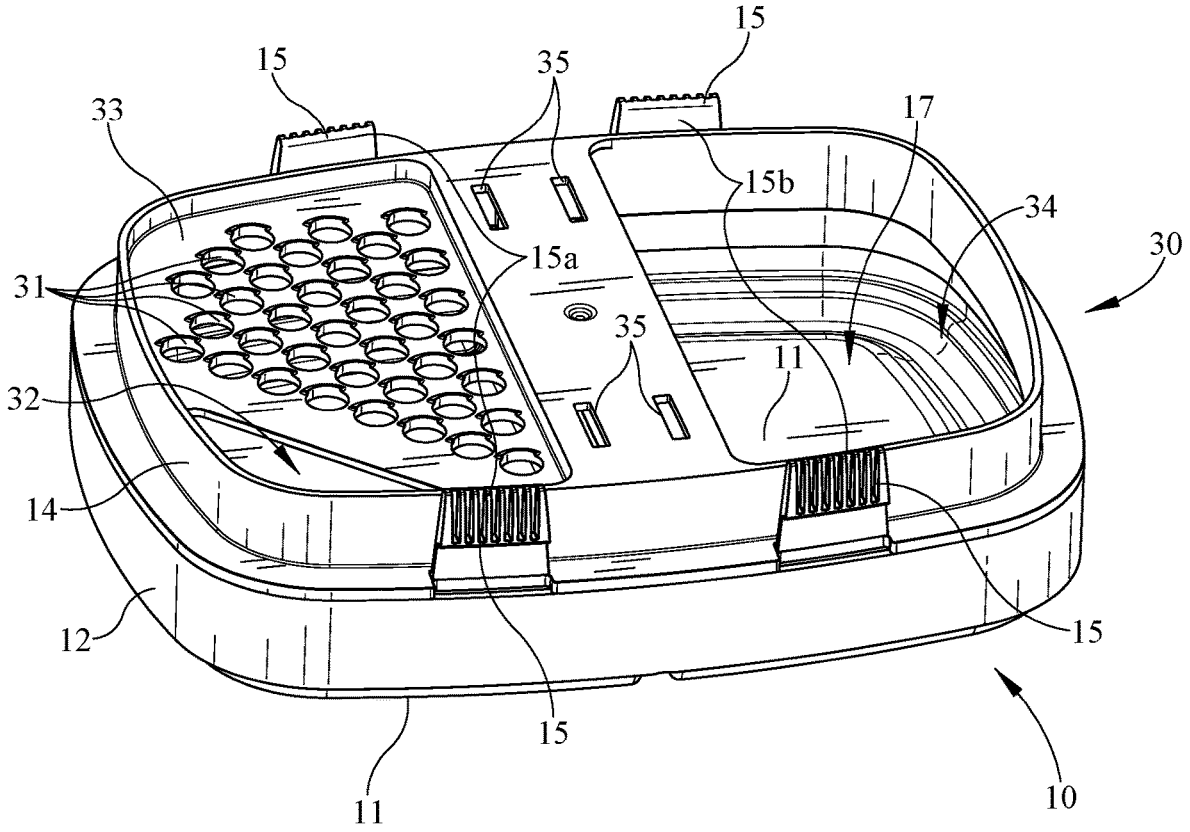
FIG. 5 illustrates a perspective view of an embodiment of a container and tray without the lid shown.

FIG. 5 shows package 5 with lid 20 removed to show more detail of tray 30 and container 10. It can be seen that tray 30 may include a coupling or attachment mechanism or a portion thereof for attachment to lid 20, such as via attachment apertures 35. Attachment apertures 35 may, for example, allow posts or other structure of lid 20 to couple or attach to tray 30 either directly or indirectly.

Figure 6:
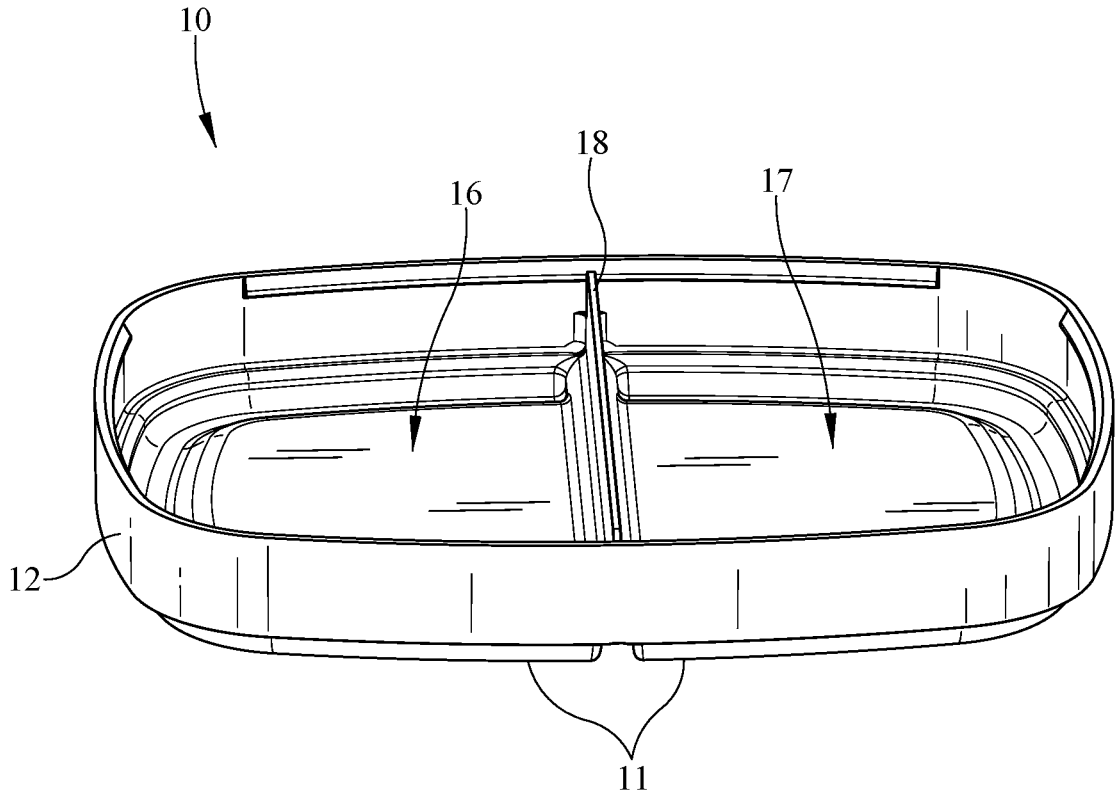
FIG. 6 illustrates a perspective view of the container of FIG. 5.

FIG. 6 illustrates an embodiment of container 10 shown with lid 20 and tray 30 removed. In FIG. 6 a partition or divider wall 18 is shown, which, if included, may separate container 10 into one or more compartments, such as first compartment 16 and second compartment 17. It is understood that more than one or two compartments may be included. Moreover, compartments may be sized, shaped, configured, oriented, and/or arranged in any of a variety of ways, and may be done so with or without relation to any or all of the other compartments if more than one compartment is included.

Figure 9:
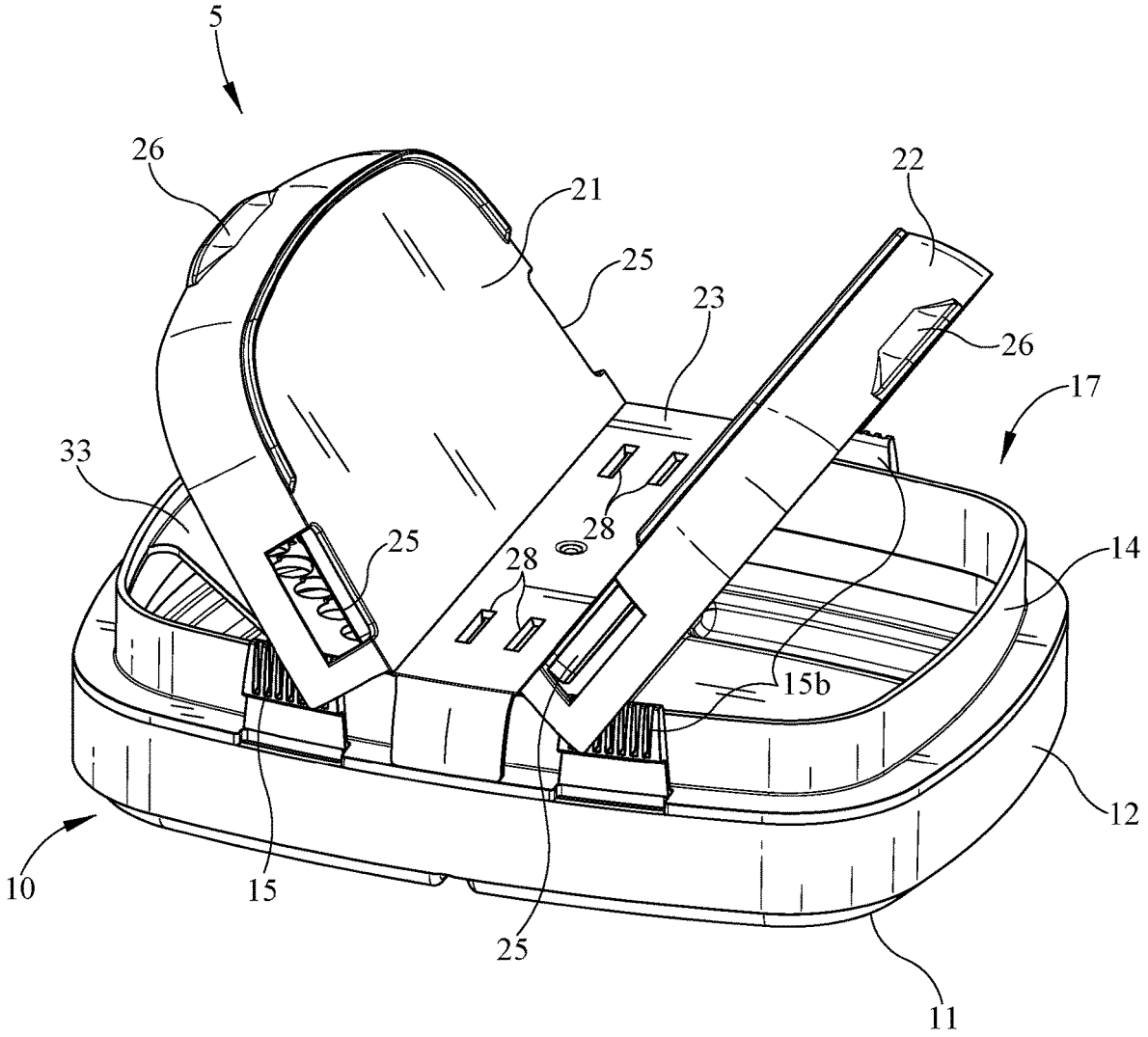
FIG. 9 illustrates a perspective view of an embodiment of a package in an open position.

FIGS. 7 and 8 illustrated tray 30 without lid 20 or container 10 shown to show the features of tray 30 in more detail. Although tabs 15 are shown as being a component of tray 30, it is understood that, in some embodiments, tabs 15 may be a part of container 10 instead of or in addition to being a part of tray 30 as shown in FIGS. 7 and 8. Tray 30 may include a skirt 36. If included, skirt 36 may be configured to attach and/or couple to container 10. For example, skirt 36 may be configured to form a friction fit and/or snap together container 10 or a portion thereof. It is understood that any of a variety of attachment mechanisms may be used to connect, couple, and/or attach tray 30 and container 10, and/or tray 30 and container 10 may be substantially integrally formed. FIG. 9 illustrates another perspective view of an embodiment of a package 5 according to the description herein.

Figure 10:
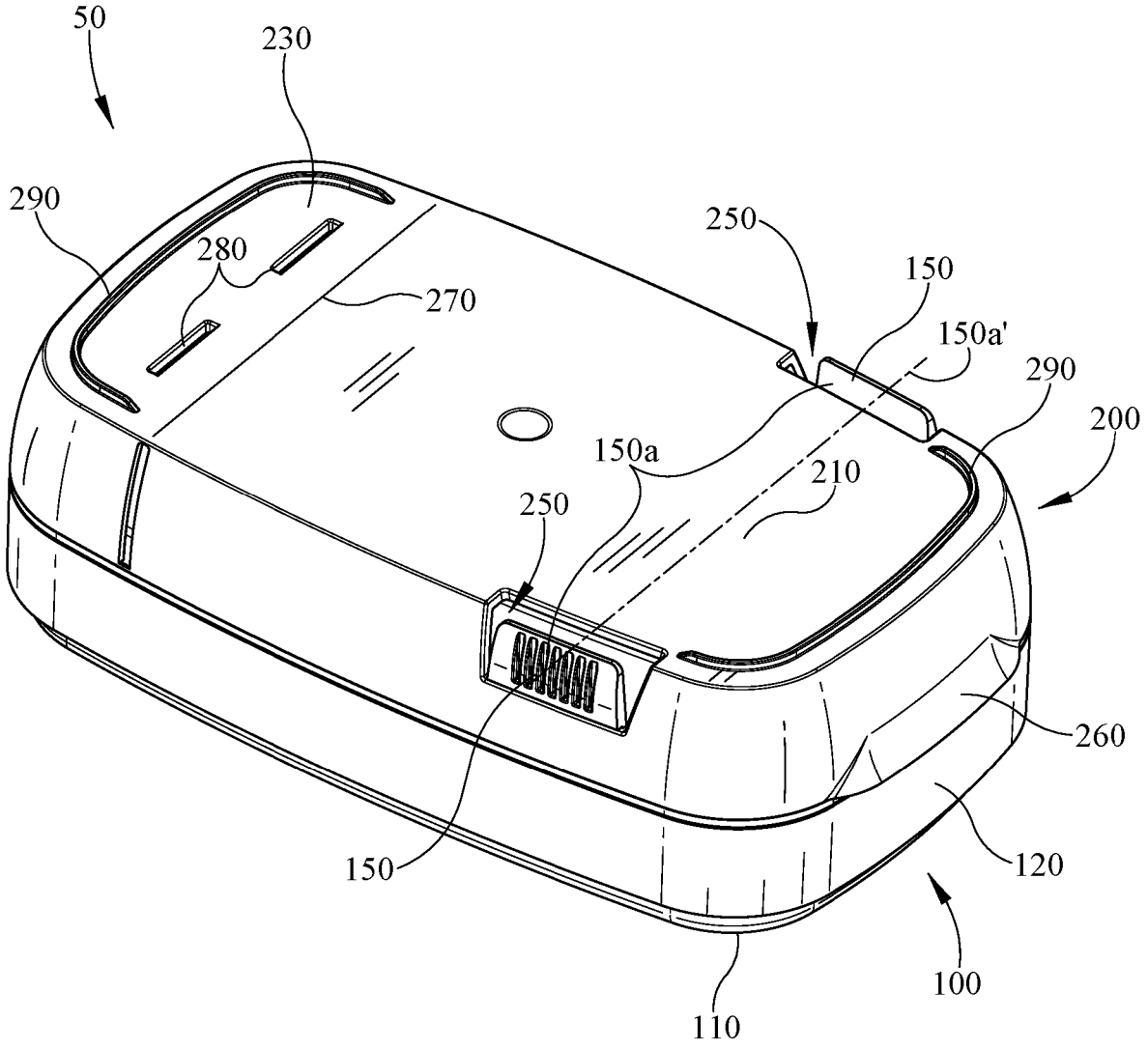
FIG. 10 illustrates a perspective view of another embodiment of a package, shown in a closed position.
Figure 11:
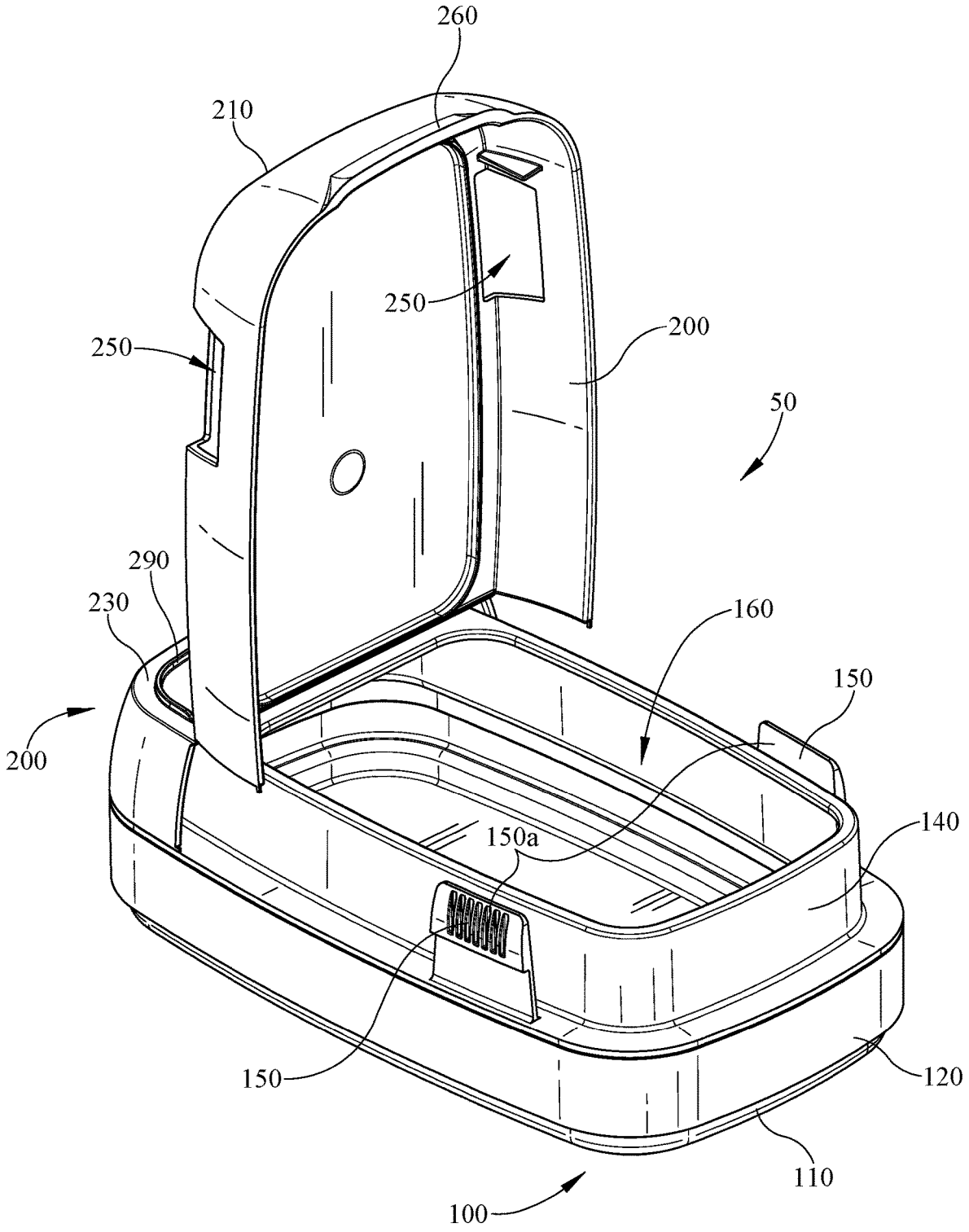
FIG. 11 illustrates a perspective view of the package of FIG. 10 shown in an open position.
Figure 17A:
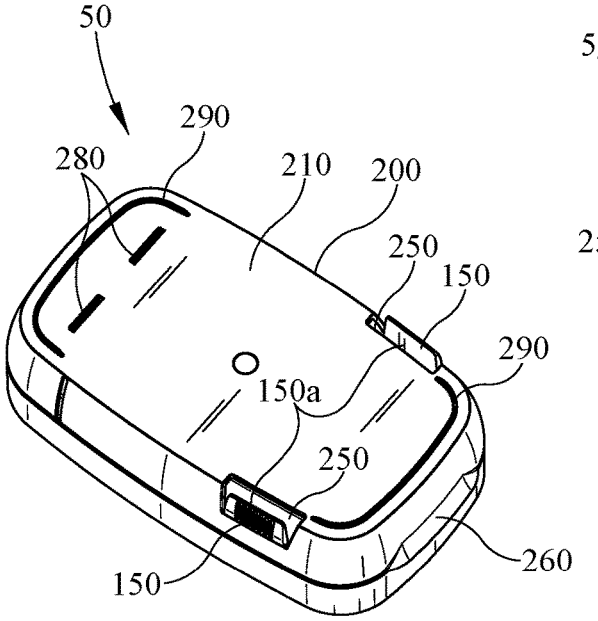
FIG. 17*a* illustrates operation of an embodiment of child resistant tabs of a package.
Figure 17B:
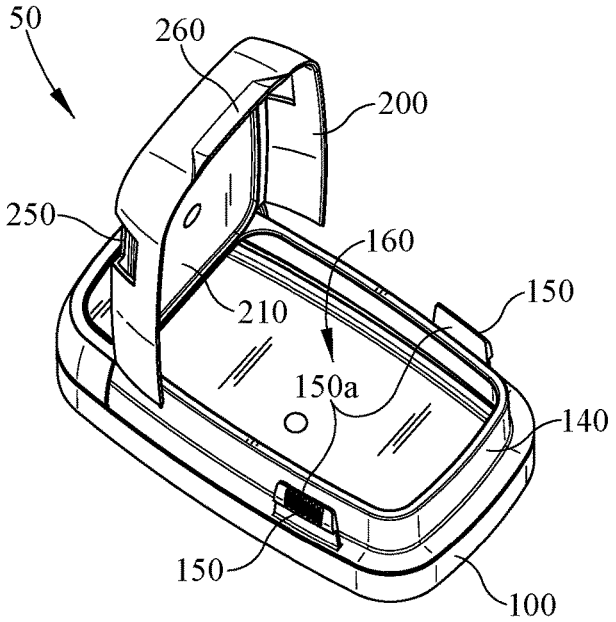
FIG. 17*b* illustrates opening of the lid of the package of FIG. 17*a* after operating the child resistant tabs.
Figure 17C:
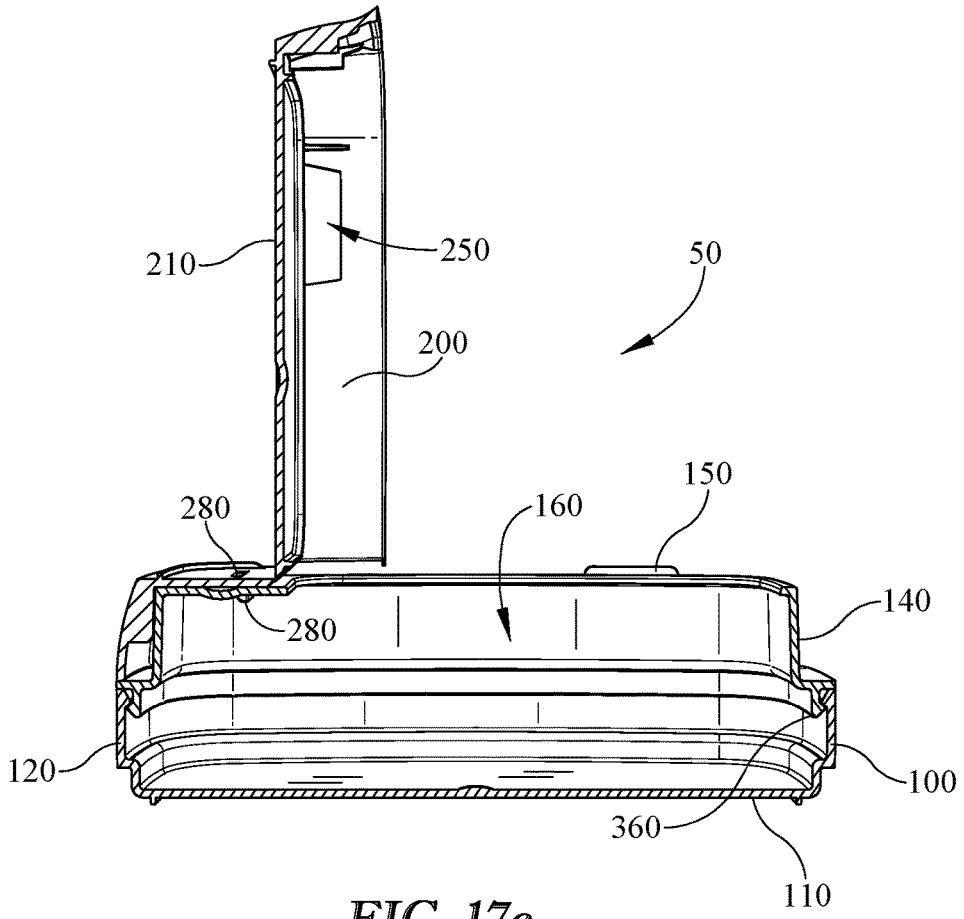
FIG. 17*c* illustrates the package of FIG. 17*c* in an open position.

FIGS. 10 and 11 illustrate an alternative embodiment, showing package 50 having a single compartment 160. This embodiment illustrates that it is not necessary to have more than one compartment. A lid 200 may be coupled to a tray 140 and/or directly to a container 100, for example, to open about a hinge or hinge line 270. Container 100 may include a floor 110 and/or a side wall 120. Tabs 150 may be employed substantially as described elsewhere herein or otherwise, for example, to engage lid slots 250 until a user selectively operates tabs 150 to disengage them from slots 250 and/or allow opening of a cover 210. A pair of opposing locking tabs 150*a* may be aligned with one another along a line 150*a*, and a user may depress or compress first pair of opposing locking tabs 150*a* toward one another along that line to disengage tabs 150 from slots 250 and/or release cover 210 so that it may open. The line between opposing pair of locking tabs 150*a* may be substantially parallel to a hinge line of hinge 270. A lid attachment portion 230 may be included and, if so, may couple and/or attach to tray 140 and/or container 100. For example, lid 200 may include an attachment mechanism such as one or more protrusions or posts 280 configured to couple or attach to, for example snap into or plug fit, a corresponding attachment mechanism of container 100 such as corresponding post apertures 350, shown for example, in FIG. 14 (see also, FIG. 17*c* showing post 280 engaging aperture 350). Lid 200 may include an area for printing, affixing, and/or attaching one or more labels to the top surface, for example, that bounded by one or more bumpers 290. Such a label, if included, may cover more or more top surface features of lid 200, such as attachment posts 280, hinge 270, and/or other surface area or features of lid 200.

Figure 12:
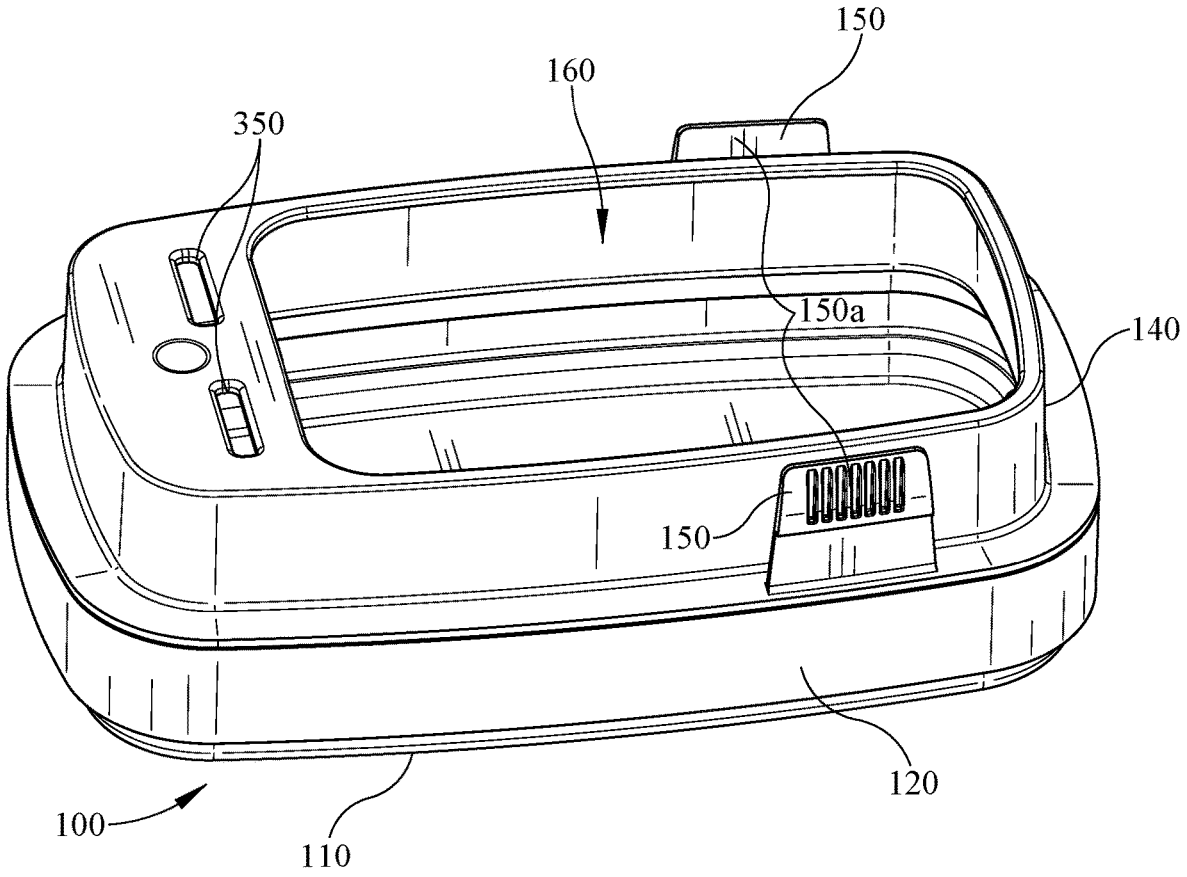
FIG. 12 illustrates a perspective view of another embodiment of a container and tray without the lid shown.

FIG. 12 shows package 50 with lid 200 removed to show more detail of tray 140 and/or container 100. Tray 140 may be an integral component of container 100 or may be a separate pieces that may be coupled to container 100. It can be seen that tray 140 may include a coupling or attachment mechanism or a portion thereof for attachment to lid 200, such as via attachment apertures 350. Attachment apertures 350 may, for example, allow posts 280 or other structure of lid 200 to couple or attach to tray 140 either directly or indirectly.

Figure 13:
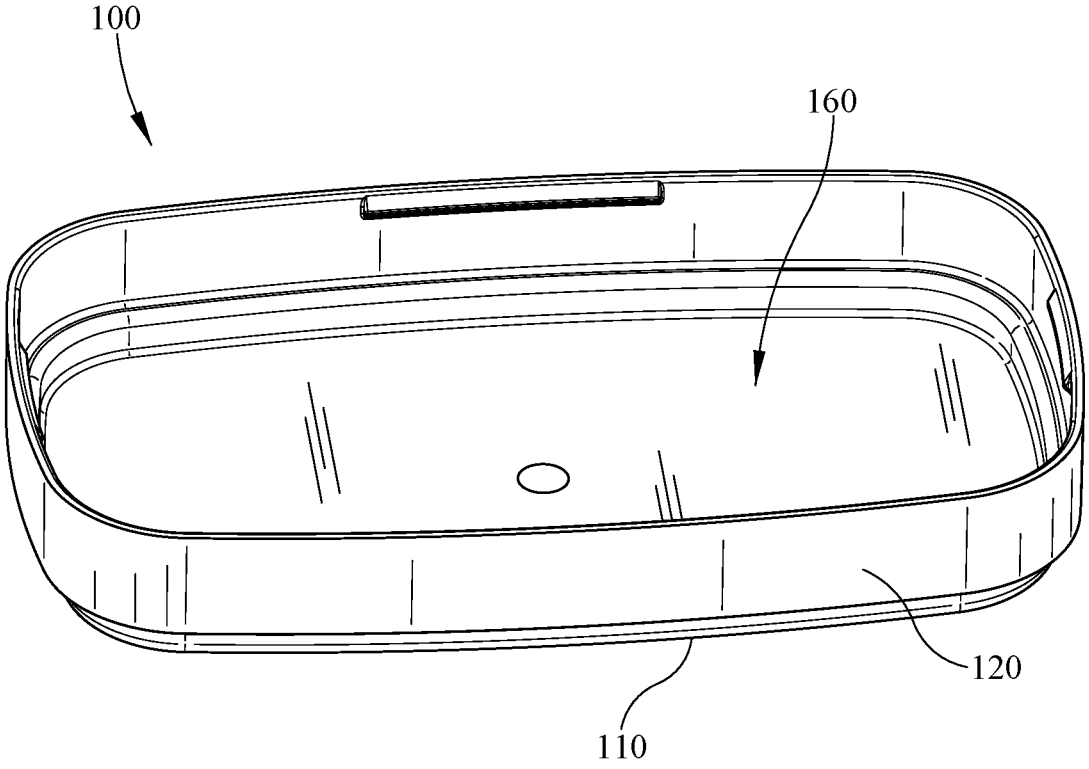
FIG. 13 illustrates a perspective view of the container of FIG. 12.

FIG. 13 illustrates an embodiment of container 100 shown with lid 200 and tray 140 removed. In FIG. 13 a partition or divider wall is not shown, though, if included, may separate container 100 into one or more compartments. It is understood that more than one or two compartments may be included. Moreover, any included compartments may be sized, shaped, configured, oriented, and/or arranged in any of a variety of ways, and may be done so with or without relation to any or all of the other compartments if more than one compartment is included.

Figure 14:
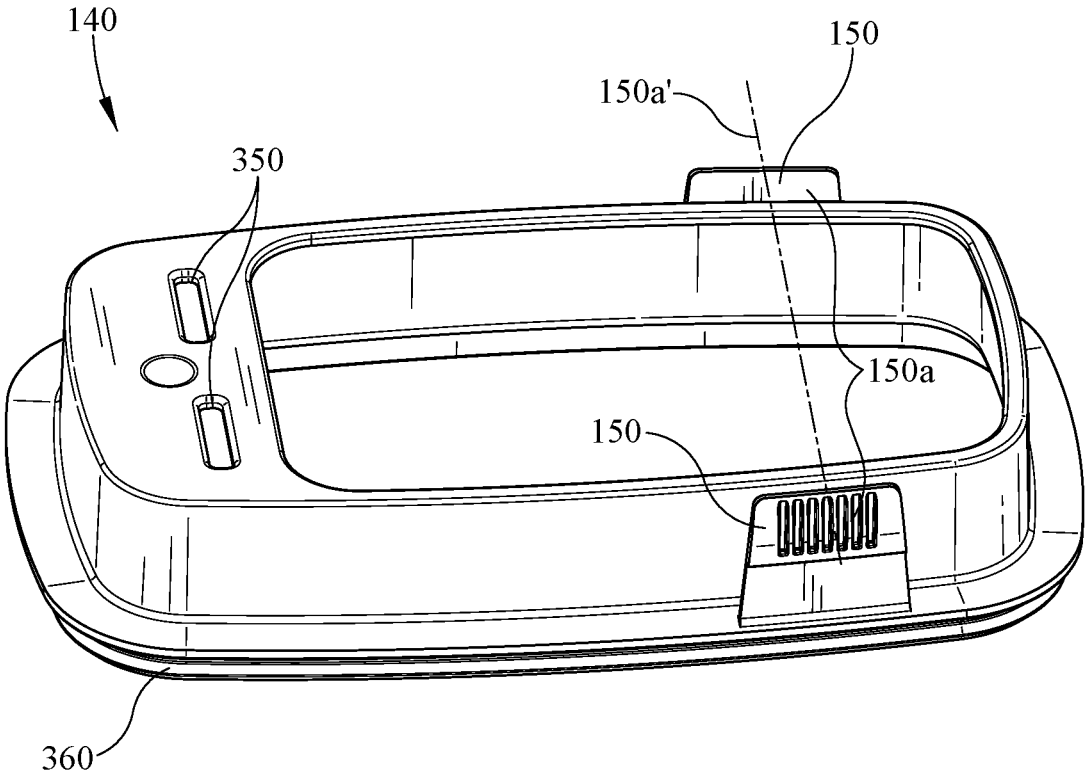
FIG. 14 illustrates a perspective view of the tray of FIG. 12.
Figure 15:
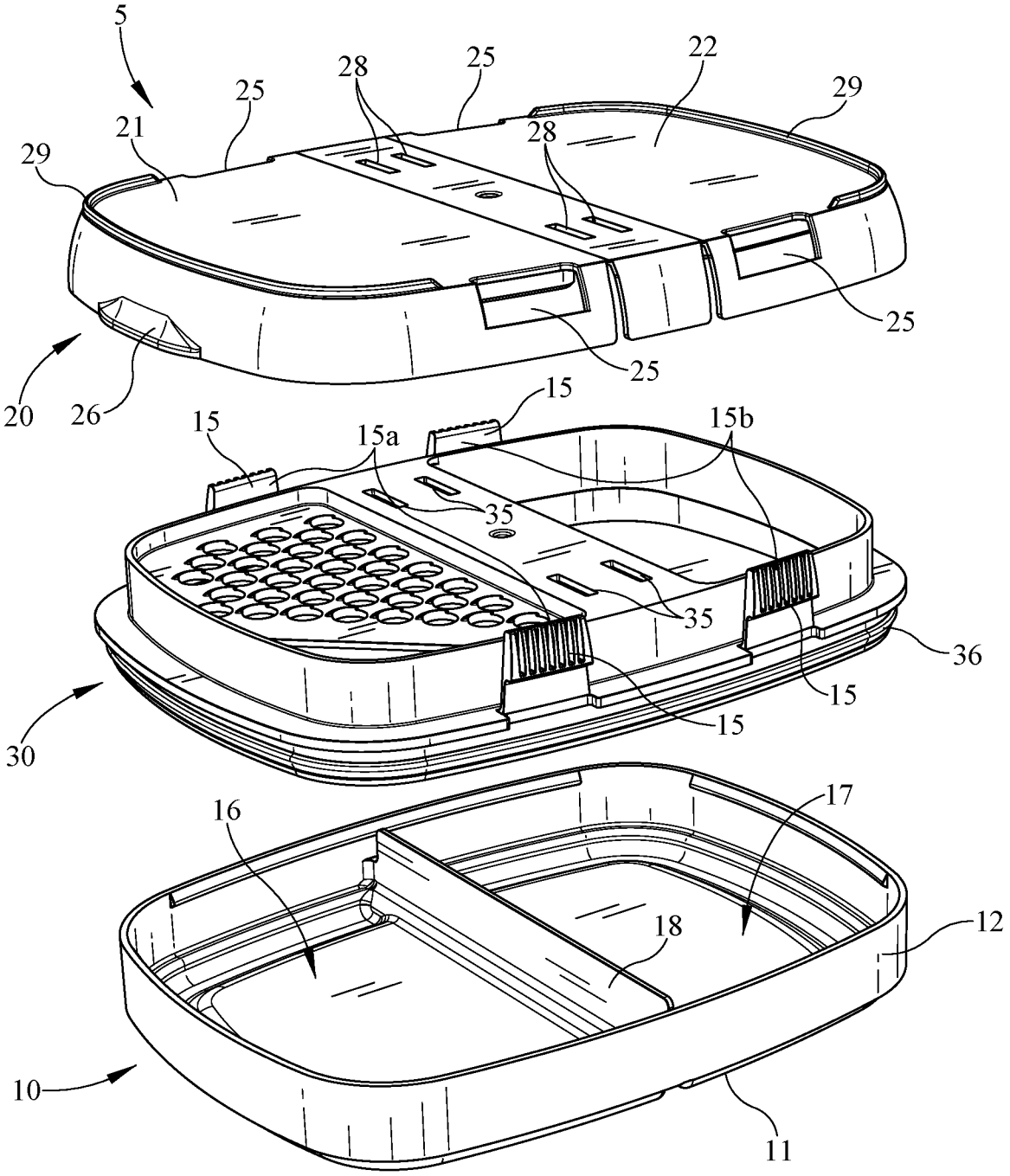
FIG. 15 illustrates an exploded assembly view of an embodiment of a lid, tray, and container of a package.

FIG. 14 illustrates tray 140 without lid 200 or container 100 to show the features of tray 140 in more detail. Although tabs 150 are shown here as being a component of tray 140, it is understood that, in some embodiments, tabs 150 may be a part of container 100 instead of or in addition to being a part of tray 140 as shown in FIG. 14. Tray 140 may include a skirt 360. If included, skirt 360 may be configured to attach and/or couple to container 100. For example, skirt 360 may be configured to form a friction fit and/or snap together container 100 or a portion thereof. It is understood that any of a variety of attachment mechanisms may be used to connect, couple, and/or attach tray 140 and container 100, and/or tray 140 and container 100 may be substantially integrally formed.

Referring again to the embodiment of package 5 shown, for example, in FIGS. 1-3, FIG. 15 illustrates an embodiment of an exploded assembly view of components of package 5, such as lid 20, tray 30, and container 10. Lid 20 may couple and/or attach to tray 30 and/or to container 10 in any of a variety of ways. The components may friction fit, snap fit, thread, bond, adhere, use fasteners such as pegs, slots, spikes, screws, hook and loop fasteners, or any combination thereof to couple and/or attach together, or may be integrally formed.

Figure 16:
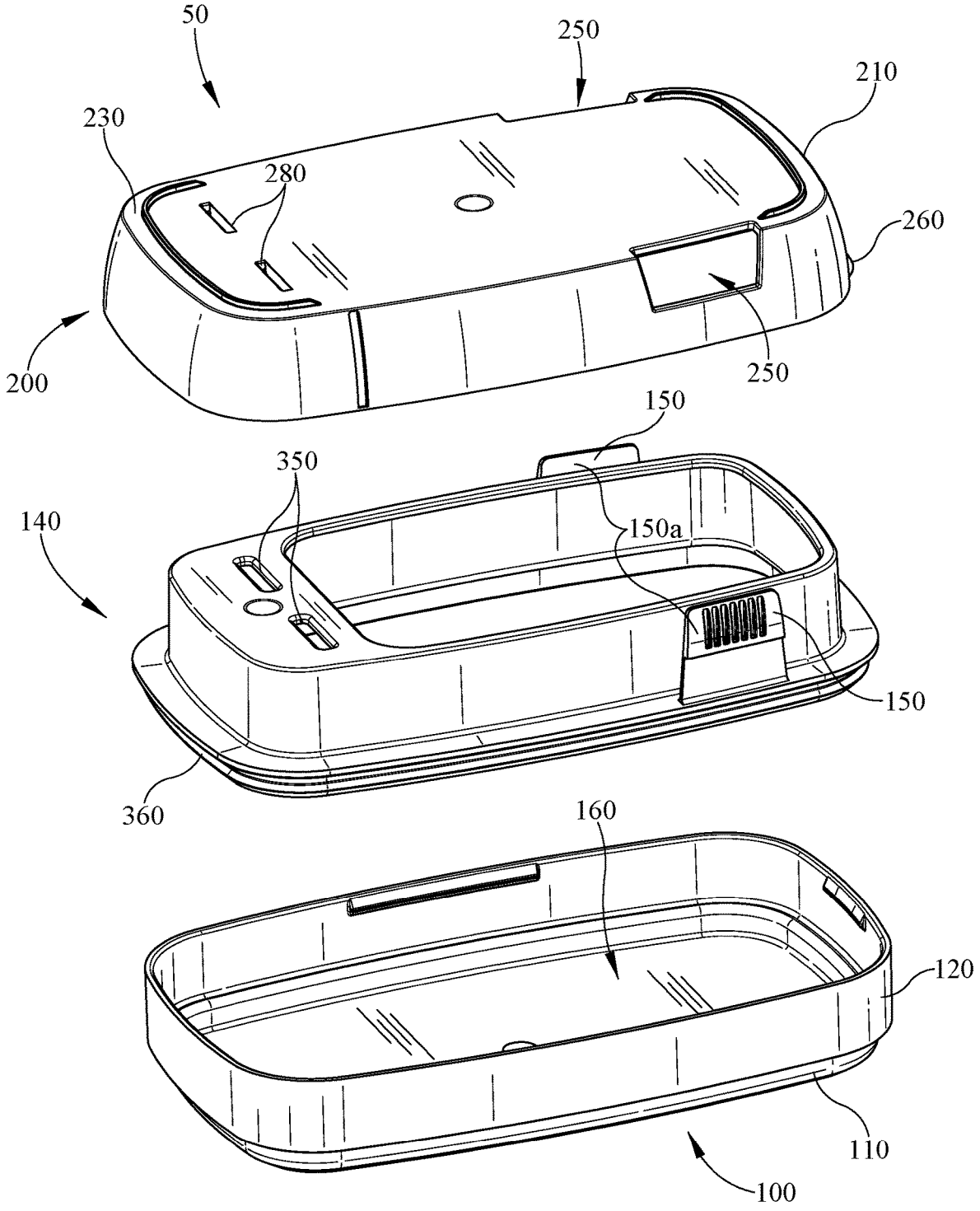
FIG. 16 illustrates an exploded assembly view of another embodiment of a lid, tray, and container of a package.

FIG. 16 illustrates package 50 by way of an exploded assembly view of components of package 50, such as lid 200, tray 140, and container 100. Lid 200 may couple and/or attach to tray 140 and/or to container 100 in any of a variety of ways. The components may friction fit, snap fit, thread, bond, adhere, use fasteners such as pegs, slots, spikes, screws, hook and loop fasteners, or any combination thereof to couple and/or attach together, or may be integrally formed FIGS. 17*a-c* illustrate operation of the locking and/or child resistant opening mechanisms described above, to allow moving the lid 200 from the closed position shown in FIG. 17*a* to the open position shown in FIG. 17*b* and in cross section in FIG. 17*c*. For example, a user may selectively press the tabs 150 inwardly toward one another and may lift the lid end 260 from the closed position to the open position. If more than one cover 210 is included, it is understood that there may be a variety of open positions.

Figure 18A:
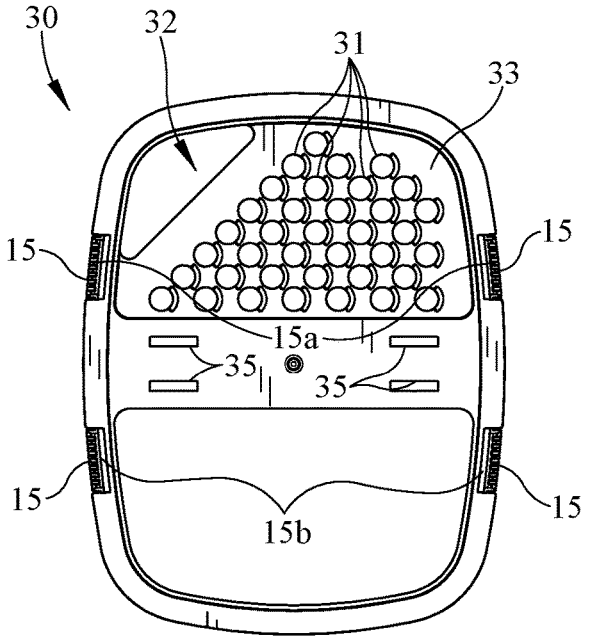
FIG. 18*a* illustrates a top view of an embodiment of a tray of a package.
Figure 18B:
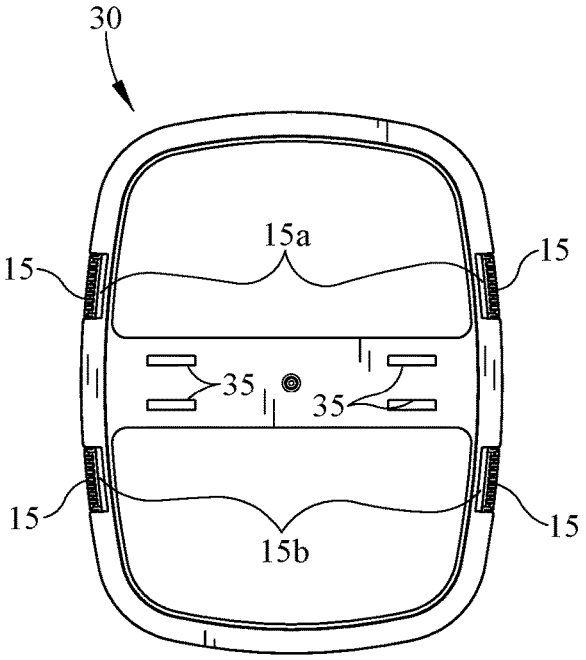
FIG. 18*b* illustrates a top view of another embodiment of a tray of a package.

FIGS. 18*a* and 18*b* illustrate alternative embodiments of tray 30. Tray 30 may include one open end and one end with a grater surface substantially as described above or, alternatively, tray 30 may include two open ends, as shown in FIGS. 18*a* and 18*b*. It is understood that any of a variety of end features may be included with tray 30 and/or at either end, including but not limited to an open end and a grater surface. It is further understood that each end may include a grater surface or other feature and that the features may be provided independent of each other. Further still, it is understood that some embodiments of package 5 may be provided without tray 30 and/or associated components.

Figure 18C:
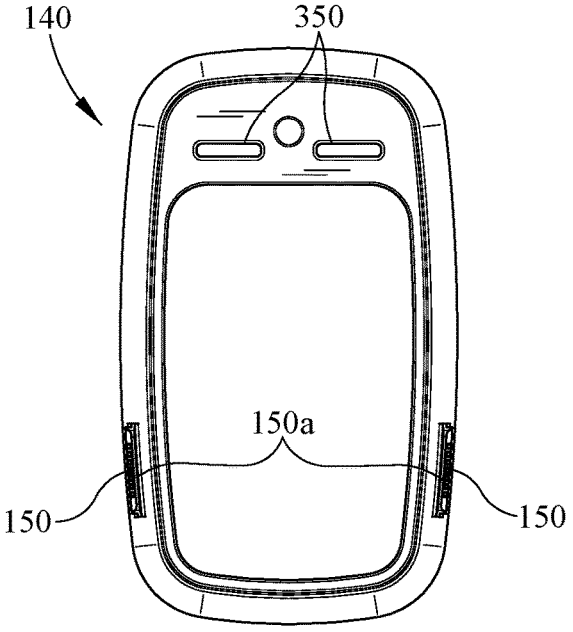
FIG. 18*c* illustrates a top view of yet another embodiment of a tray of a package.

FIG. 18*c* illustrates a top view of an embodiment of tray 140. Tray 140 may include any of a variety of features, including but not limited to, a grater surface, openings, and/or virtually any other features. It is understood that each end may include a grater surface or other feature and that the features may be provided independent of each other. It is further understood that some embodiments of package 50 may be provided without tray 140 and/or associated components.

It is understood that package 5 and/or package 50, container 10 and/or container 100, lid 20 and/or lid 200, and/or tray 30 and/or tray 300, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 5 and/or package 50, container 10 and/or container 100, lid 20 and/or lid 200, and/or tray 30 and/or tray 300, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 5 and/or package 50, container 10 and/or container 100, lid 20 and/or lid 200, and/or tray 30 and/or tray 300, and/or any component thereof.

It is further understood that any of a variety of processes or combination thereof may be used to form package 5 and/or package 50, container 10 and/or container 100, lid 20 and/or lid 200, and/or tray 30 and/or tray 300, and/or any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, package 5 and/or package 50, container 10 and/or container 100, lid 20 and/or lid 200, and/or tray 30 and/or tray 300, and/or any component thereof may be formed substantially of injection molded and/or thermoformed suitable plastics material, although other materials and forming processes may be used instead of or in addition to injection molding and thermoforming, respectively. Various materials and/or processes may be used to form package 5 and/or package 50, container 10 and/or container 100, lid 20 and/or lid 200, and/or tray 30 and/or tray 300, and/or any component thereof, as will be understood by one of ordinary skill in the art. In some embodiments, container 10 and/or container 100, lid 20 and/or lid 200, and/or tray 30 and/or tray 300, and/or any component thereof, may be substantially a one-piece design and/or substantially formed as an integral or unitary structure.

It is understood that, while some directional terms are used herein, such as top, bottom, upper, lower, inward, outward, upward, downward, etc., these terms are not intended to be limiting but rather to relate to one or more exemplary orientations, positions, and/or configurations of package 5 and/or package 50, container 10 and/or container 100, lid 20 and/or lid 200, and/or tray 30 and/or tray 300, and/or any component thereof. It is understood that container 10 and/or container 100, lid 20 and/or lid 200, and/or tray 30 and/or tray 300, and/or any component of package 5 and/or package 50, may be oriented differently than shown in the various figures so that, for example, a different portion of container 10 or container 100, other than floor 11 or floor 110, is in contact with an underlying surface.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A package, comprising:

a container having a floor and a side wall that cooperate to form a product storage region; and a lid having a cover that is movable between a closed position in which the cover is at least partially blocking access to the product storage region, and an open position in which the cover is at least partially moved away from the closed position such that the product storage region is accessible by a user;

wherein the container includes at least one pair of opposed depressible tabs that in a relaxed state are configured to retain the lid in a locked state, and in a compressed state are configured to allow the lid to move from the closed position to the open position;

wherein the lid includes a pair of opposed apertures configured to align with the at least one pair of opposed tabs in the closed state and allow disengagement of the tabs when the tabs are in the compressed state such that the tabs disengage the pair of opposed apertures and allow movement of the lid from the closed position to the open position; and wherein the container includes a tray coupled to a container base, and wherein the tray includes the pair of opposed depressible tabs.

2. The package of claim 1, wherein the tray is attachable to the container base by a friction fit.

3. The package of claim 1, wherein the lid is attachable to the container by an attachment mechanism that includes lockable protrusions that engage and are retained in corresponding slots, wherein at least one of the lockable protrusions and slots are on the container and a corresponding at least one of the lockable protrusions and slots are on the lid.

4. The package of claim 1, wherein the lid is covered by a label.

5. The package of claim 1, wherein the lid is movable from the closed position to the open position, and from the open position to the closed position, about a hinge.

6. The package of claim 5, wherein the lid hinge lies along an axis of lid rotation that is substantially parallel to a line through the pair of opposed depressible tabs.

7. The package of claim 1, wherein the tray is attachable to the container base by a snap fit.

8. A package assembly, comprising:

a container having a floor and a side wall that cooperate to form a product storage region;

a tray that is configured to be attachable to the container side wall; and a lid that is configured to be attachable to the tray;

wherein the lid includes a cover that is movable between a closed position in which the cover at least partially blocks access to the product storage region, and an open position in which the cover is at least partially moved away from the closed position such that the product storage region is accessible by a user;

wherein the container includes at least one pair of opposed depressible tabs that in a relaxed state are configured to retain the cover in a locked state, and in a compressed state are configured to allow the cover to move from the closed position to the open position;

wherein the cover includes a pair of opposed apertures configured to align with the at least one pair of opposed tabs in the closed state and allow disengagement of the tabs when the tabs are in the compressed state such that the tabs disengage the pair of opposed apertures and allow movement of the cover from the closed position to the open position and;

wherein the tray includes the at least one pair of opposed depressible tabs.

9. The package assembly of claim 8, wherein the container, the tray, and the lid are independently injection molded of plastics materials and attached together to form the package.

* * * * *